US009506329B2

(12) United States Patent
Massey et al.

(10) Patent No.: US 9,506,329 B2
(45) Date of Patent: Nov. 29, 2016

(54) ROTATING HANGER

(71) Applicant: Cameron International Corporation, Houston, TX (US)

(72) Inventors: Nolan Massey, Vernal, UT (US); Jay P. Painter, Friendswood, TX (US); Jose R. Navar, Houston, TX (US); Justin T. Clifton, Westminster, CO (US); Amy A. Griggs, Spring, TX (US)

(73) Assignee: Cameron International Corporation, Houston, TX (US)

( * ) Notice: Subject to any disclaimer, the term of this patent is extended or adjusted under 35 U.S.C. 154(b) by 50 days.

(21) Appl. No.: 14/194,299

(22) Filed: Feb. 28, 2014

(65) Prior Publication Data

US 2015/0247387 A1 Sep. 3, 2015

(51) Int. Cl.

| | |
|---|---|
| ***E21B 43/10*** | (2006.01) |
| ***E21B 33/04*** | (2006.01) |
| ***E21B 33/14*** | (2006.01) |
| ***E21B 47/00*** | (2012.01) |

(52) U.S. Cl.

CPC ..... *E21B 43/10* (2013.01); *E21B 33/0415* (2013.01); *E21B 33/14* (2013.01); *E21B 47/0005* (2013.01)

(58) Field of Classification Search

CPC .... E21B 43/10; E21B 33/0412; E21B 33/06; E21B 33/04; E21B 43/106; E21B 33/14; E21B 47/0005

See application file for complete search history.

(56) References Cited

U.S. PATENT DOCUMENTS

| | | | | |
|---|---|---|---|---|
| 3,105,556 | A | 10/1963 | Raulins | |
| 3,628,604 | A * | 12/1971 | Childers et al. | 166/338 |
| 3,999,604 | A | 12/1976 | Amancharla et al. | |
| 4,807,705 | A | 2/1989 | Henderson et al. | |
| 5,311,941 | A | 5/1994 | Baugh | |
| 8,528,650 | B1 | 9/2013 | Smith et al. | |
| 2002/0117305 | A1* | 8/2002 | Calder et al. | 166/358 |
| 2008/0017368 | A1 | 1/2008 | Hopper et al. | |
| 2012/0305269 | A1* | 12/2012 | Bories et al. | 166/382 |

OTHER PUBLICATIONS

Hanson et al., U.S. Appl. No. 13/867,947, filed Apr. 22, 2013.

* cited by examiner

*Primary Examiner* — Brad Harcourt
(74) *Attorney, Agent, or Firm* — Eubanks PLLC

(57) ABSTRACT

A casing hanger assembly is provided. In one embodiment, a system includes a casing hanger and a landing shoulder for receiving the casing hanger and supporting the casing hanger within a wellhead. The casing hanger and the landing shoulder have complementary features that cooperate to inhibit rotation of the casing hanger with respect to the landing shoulder. Additional systems, devices, and methods are also disclosed.

19 Claims, 6 Drawing Sheets

ROTATING HANGER

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, pumps, fluid conduits, and the like, that control drilling or extraction operations.

As will be appreciated, wells are often lined with casing that generally serves to stabilize the well and to isolate fluids within the wellbore from certain formations penetrated by the well (e.g., to prevent contamination of freshwater reservoirs). Such casing is frequently cemented into place within the well. During a cement job, cement can be pumped down a casing string in a well, out the bottom of the casing string, and then up the annular space surrounding the casing string. The cement is then allowed to set in the annular space.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to the installation of casing hangers in wellhead assemblies. In some instances, such as during cementing of the casing strings within the wells, top drives or other rotating machines are used to drive rotation of casing hangers and attached casing strings. In a cementing context, such rotation may reduce undesirable voids in the cement. But this rotation can also cause tightening of a threaded connection between the casing hanger and a device (e.g., a landing joint or a running tool) that transmits torque from the rotating machine to the casing hanger, and this tightening can hamper disconnection of the torque-transmitting device from the casing hanger. In at least some embodiments, however, a casing hanger has anti-rotation features, such as keys, that can be used to prevent rotation of the casing hanger to facilitate disconnection of the landing joint or other torque-transmitting device.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
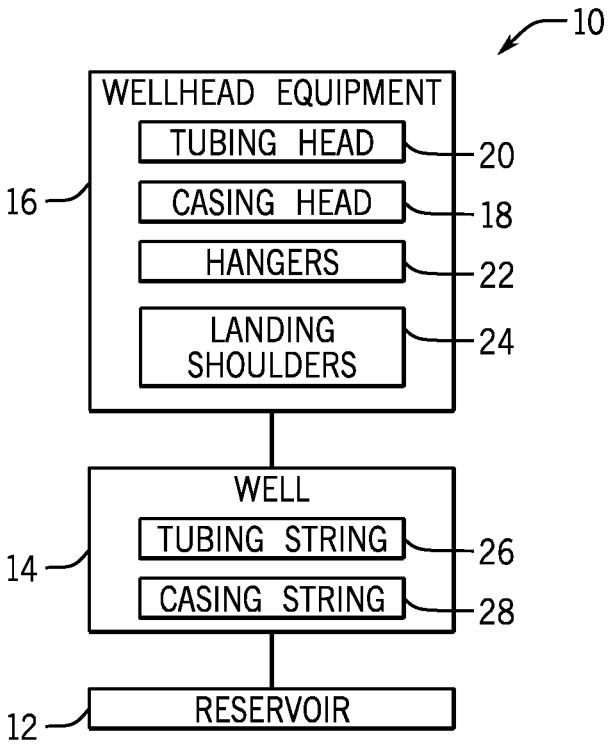
FIG. 1 generally depicts various components, including one or more casing strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well 14. As depicted, the wellhead equipment 16 includes at least one casing head 18 and tubing head 20, as well as hangers 22. But the components of the wellhead equipment 16 can differ between applications, and could include a variety of casing heads, tubing heads, hangers, sealing assemblies, stuffing boxes, pumping tees, and pressure gauges, to name only a few possibilities.

The hangers 22 can be positioned on landing shoulders 24 within the tubing and casing heads. These landing shoulders 24 can be integral parts of the tubing and casing heads or can be provided by other components, such as packoffs, other sealing assemblies, or landing rings disposed in the tubing and casing heads. Each of the hangers 22 can be connected to a tubing string 26 or a casing string 28 to suspend such strings within the well 14. The well 14 can include a single casing string 28 or include multiple casing strings 28 of different diameters. Casing strings 28 are often cemented in place within the well. During a cement job, cement is typically pumped down the casing string. A plug is then pumped down the casing string with a displacement fluid (e.g., drilling mud) to cause the cement to flow out of the bottom of the casing string and up the annular space around the casing string.

Rotating the casing string during cementing can increase uniformity of the cement about the casing string and reduce the size or frequency of undesirable cavities or fissures in the cement. Further, rotating the casing string can also facilitate running of the casing string into the well through the wellhead. The casing strings can be rotated via casing hangers attached to the casing strings. Any suitable devices or machines may be used to rotate the casing hangers (and their attached casing strings) and to run the casing strings into wells. For example, a top drive can be used to run a casing string into a well and to rotate the casing string.

Figure 2:
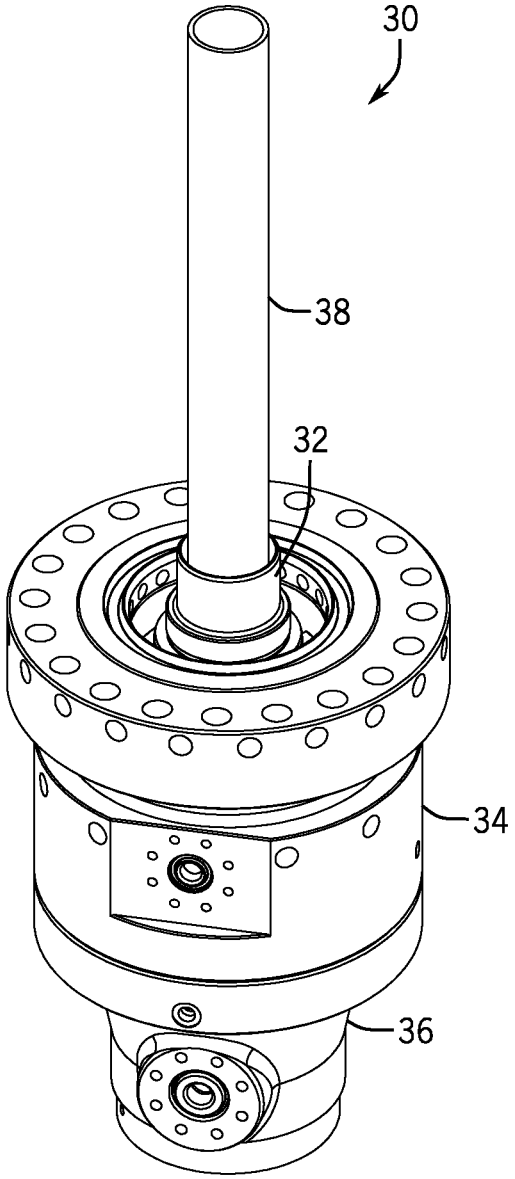
FIG. 2 is a perspective view of a wellhead assembly including a casing hanger in accordance with one embodiment.

One example of a wellhead assembly 30 that facilitates rotating of a casing string is depicted in FIG. 2. In this embodiment, the assembly 30 includes a casing hanger 32 received in a wellhead. This wellhead is shown as including a casing spool 34 coupled to a casing head 36, though the wellhead may differ in other embodiments. And as described below in greater detail, the casing hanger 32 can be run into the wellhead with a landing joint 38.

Figure 3:
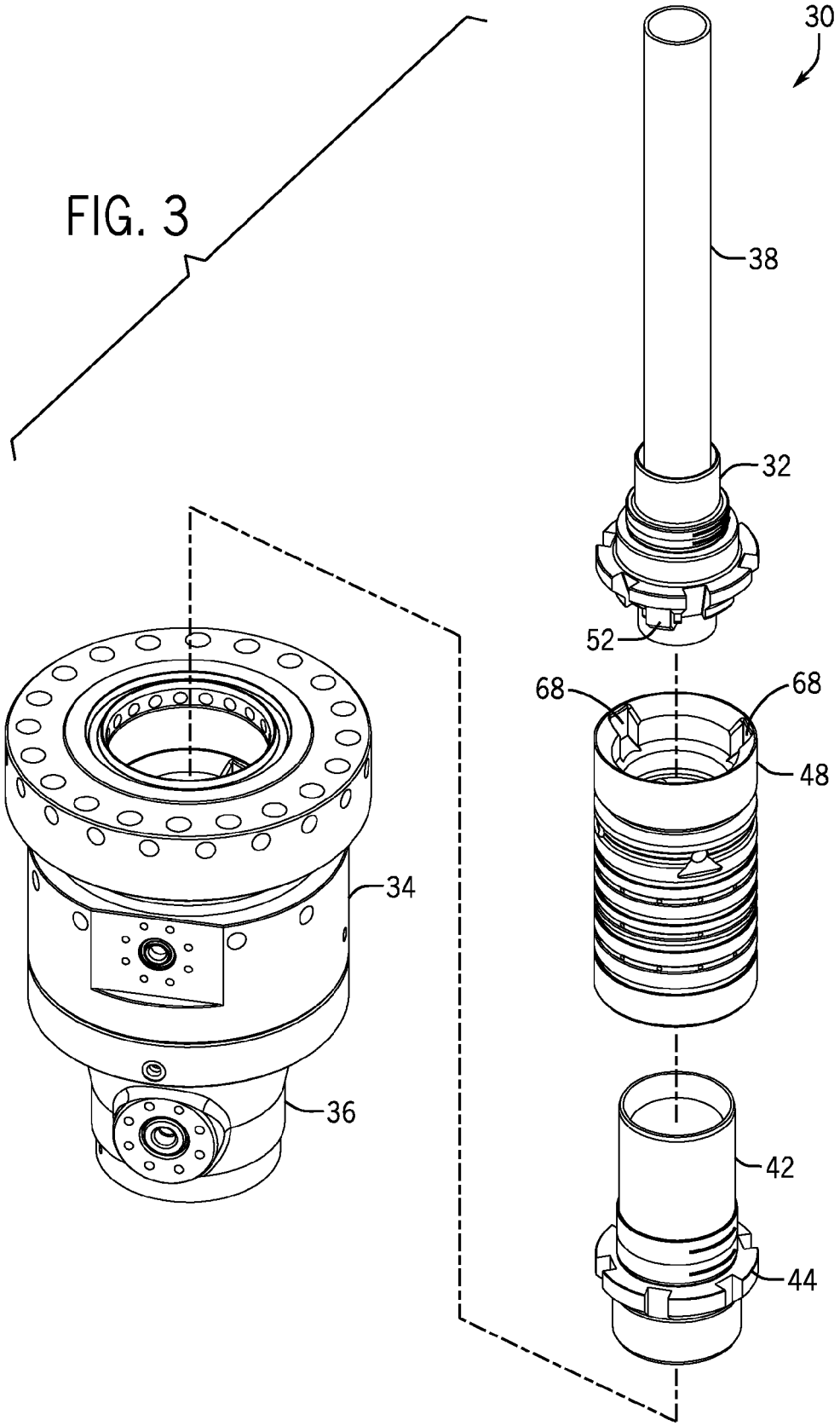
FIG. 3 is an exploded view of the wellhead assembly of FIG. 2.
Figure 5:
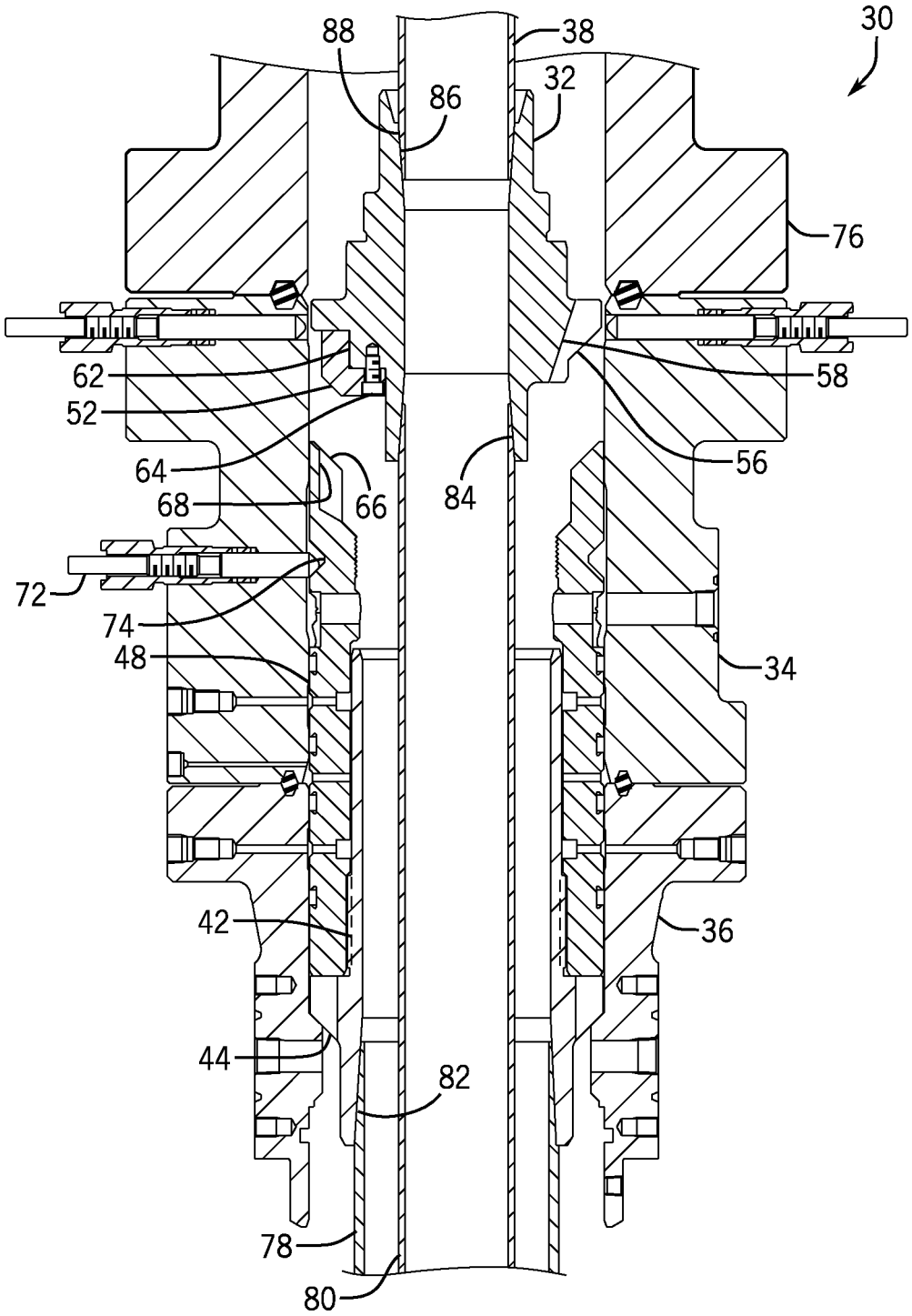
FIG. 5 is a cross-section showing the casing hanger and packoff of FIG. 4 within a wellhead assembly in accordance with one embodiment.
Figure 6:
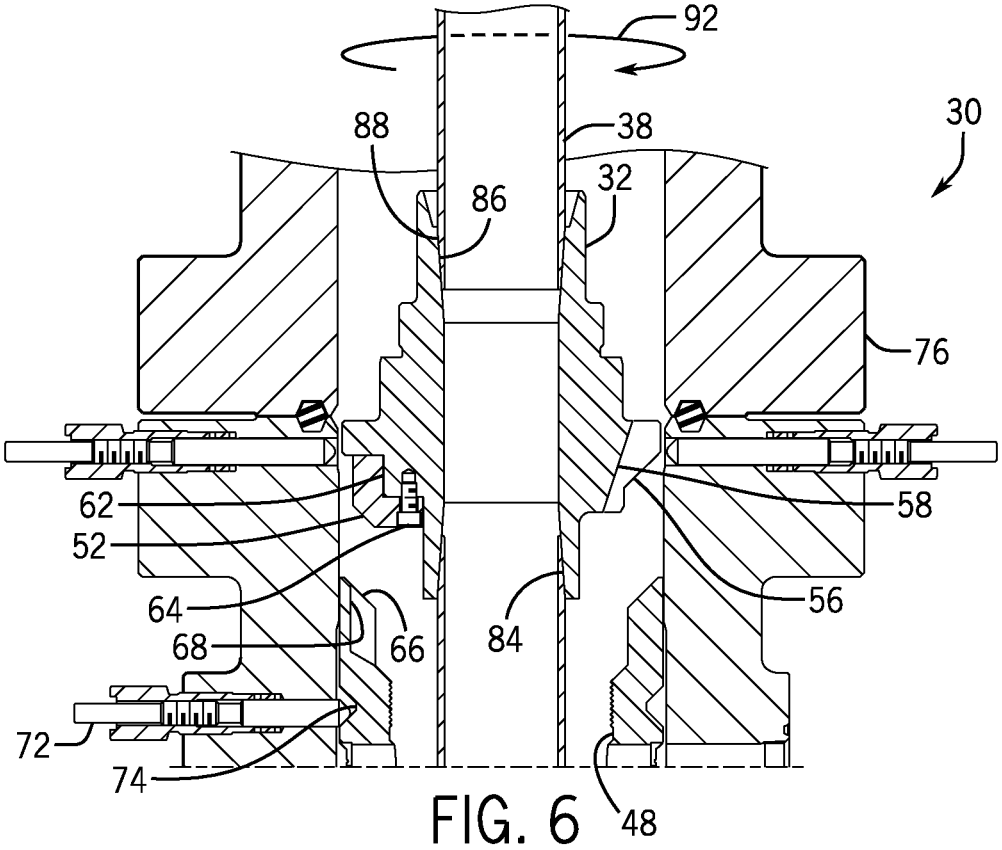
FIG. 6 generally depicts rotation of the casing hanger within the wellhead assembly via a landing joint in accordance with one embodiment.

Additional aspects of the wellhead assembly 30 are illustrated in the exploded view of FIG. 3. As shown here, the wellhead assembly 30 includes an additional casing hanger 42. The casing hanger 42 (which can be attached to a casing string, as shown in FIG. 5) includes a landing shoulder 44, which can be landed on a mating shoulder within the wellhead assembly 30, such as a shoulder of the casing head 36. A packoff 48 can be installed within the wellhead above the casing hanger 42. As will be appreciated, the packoff 48 can carry various seals for isolating the annular space below the packoff from the space above the packoff. Once installed within the wellhead, the packoff 48 receives the casing hanger 32.

The casing hanger 32 can be rotated to cause an attached casing string, such as casing string 80 (FIG. 5), to rotate. In some embodiments, the landing joint 38 and the casing hanger 32 are connected with a threaded interface. More specifically, the landing joint 38 can be rotated in one direction (e.g., clockwise) to thread the landing joint 38 into the casing hanger 32. This allows the casing hanger 32 and an attached casing string to be rotated with the landing joint 38 (e.g., by rotating the landing joint 38 in the same direction as during connection to the casing hanger 32).

Although the threaded connection can transmit torque from the landing joint 38 to the casing hanger 32 to rotate the casing string, rotating the casing hanger 32 in this manner can also tighten the threaded connection. In some instances, this tightened connection could hinder disengagement of the landing joint 38 from the casing hanger 32 following installation. That is, when the rotational direction of the landing joint 38 is reversed, the casing hanger 32 could rotate with the landing joint 38 rather than unthreading from it. Accordingly, casing hangers 32 can include anti-rotation features that cooperate with complementary features of other wellhead components to inhibit rotation of the casing hangers 32 while disconnecting landing joints 38.

Figure 4:
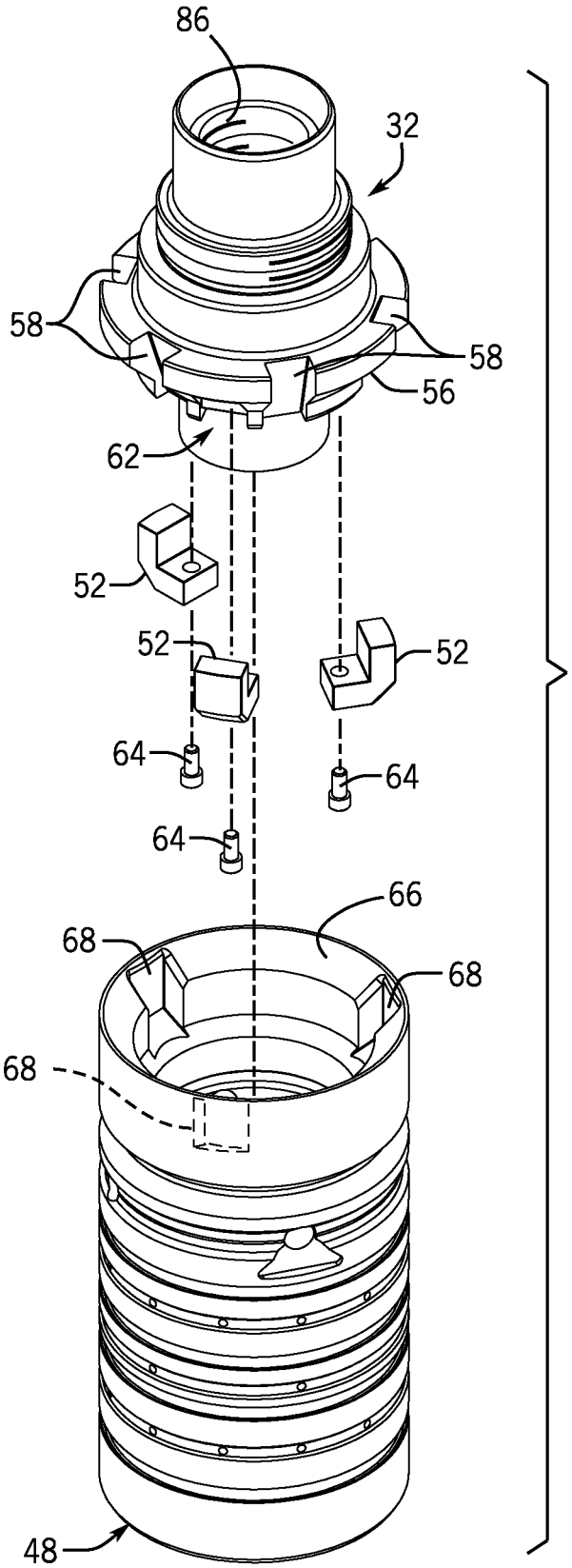
FIG. 4 is an exploded view depicting the casing hanger as having keys and a packoff as having a landing shoulder with keyways for receiving the keys in accordance with one embodiment.

In some embodiments, these anti-rotation features include keys on the casing hanger 32. For instance, as depicted in FIGS. 3 and 4, the casing hanger 32 includes keys 52 installed on its surface. In this embodiment, the keys 52 are provided in the form of separate lugs that are fastened into recesses 62 of a landing shoulder 56 of the casing hanger 32 with bolts 64. As described in greater detail below, the casing hanger 32 can be lowered into keyed engagement with a landing shoulder 66 of the packoff 48. This landing shoulder 66 supports the casing hanger 32 within the wellhead. Slots or keyways 68 can be machined or otherwise formed in the landing shoulder 66. The mating engagement of the keys 52 with the slots 68 inhibits rotation of the casing hanger 32 with respect to the landing shoulder 66. This allows the landing shoulder 66 to resist the high break-out torque that may be needed to remove the landing joint 38 from the casing hanger 32 after rotating a casing string during cementing, thus facilitating removal of the landing joint 38 from the casing hanger 32. Further, preventing rotation of the landed casing hanger 32 reduces the risk that cement that has set around the casing string will be damaged while removing the landing joint 38.

Certain other features are also depicted in FIG. 4. The depicted casing hanger 32 also includes flow-by recesses 58, for example. These recesses 58 allow fluid to flow through the landing shoulder 56 when the casing hanger 32 is installed in a wellhead. Further, the packoff 48 includes various circumferential recesses. Seals can be installed in some of these recesses to enable the packoff 48 to seal an annular space within a wellhead.

While one example of a casing hanger 32 with anti-rotation features is illustrated in FIGS. 3 and 4, it is noted that other embodiments have different configurations. For instance, the casing hanger 32 could have a different number of keys 52 (including only a single key in one embodiment), the keys 52 could be attached to the casing hanger 32 in a different manner, or the keys 52 could be formed integrally with the casing hanger 32, to name just a few examples. In other embodiments, the position of the mating keys and slots is reversed, with the casing hanger having slots for receiving keys provided on a landing shoulder that receives the casing hanger. Still further, other anti-rotation features, such as pins or cotters, could be used in addition to or instead of the keys 52 and slots 68.

An example of the casing hanger 32 being run into a wellhead assembly is generally depicted in FIGS. 5-9. As shown in FIG. 5, the wellhead assembly 30 includes the casing spool 34, the casing head 36, and a blowout preventer stack 76 coupled to the top of the casing spool 34. The lower casing hanger 42 is landed on a landing shoulder of the casing head 36 and is attached (e.g., via a threaded interface 82) to a casing string 78. The packoff 48 is installed over the casing hanger 42 and is secured within the bore of the wellhead with one or more lockscrews 72 that engage a recess 74 of the packoff 48.

The casing hanger 32 is attached to a casing string 80 via a threaded interface 84 and can be run into the wellhead assembly through the blowout preventer stack 76. In at least some embodiments, the casing hanger 32 includes an upper end with a threaded surface 86 that enables the casing hanger 32 to receive a threaded end 88 of the landing joint 38. This, in turn, allows the casing hanger 32 to be inserted into the wellhead without a separate running tool connecting the landing joint 38 to the casing hanger 32.

The casing hanger 32 and attached casing string 80 can be rotated as the casing hanger 32 is run into the wellhead. For example, during cementing of the casing string 80 within the well (e.g., by pumping cement through the bottom of the string 80 and up the surrounding annulus), the casing hanger 32 can be positioned within the wellhead assembly over the landing shoulder 66 and rotated through the blowout preventer stack 76 by the landing joint 38, as generally indicated by arrow 92 in FIG. 6. Although the casing hanger 32 could be rotated above the wellhead assembly (e.g., above the blowout preventer stack 76) and then lowered onto the landing shoulder 66, rotating the casing hanger 32 within the wellhead assembly during cementing reduces the axial travel of the casing hanger 32 (and the casing string 80) as it is landed onto shoulder 66 after cementing, thus reducing the likelihood that such movement will damage cement that has set.

Whether rotated above or within the wellhead assembly, this rotation can tighten the threaded connection between the casing hanger 32 and the landing joint 38. In some instances, simply reversing the direction of rotation may not be sufficient to disconnect these two components. That is, friction at the tightened threaded connection between the landing joint 38 and the casing hanger 32 can cause the casing hanger 32 to also rotate in the reversed direction with the landing joint 38 rather than unthreading the connection. But in accordance with the present techniques, mating anti-rotation features (e.g., keys 52 and slots 68) are used to limit rotation of the casing hanger 32 with respect to the landing shoulder 66 to facilitate disconnection of the landing joint 38 (or some other installation device, such as a device having a running tool connected to the landing joint 38) from the casing hanger 32.

Figure 7:
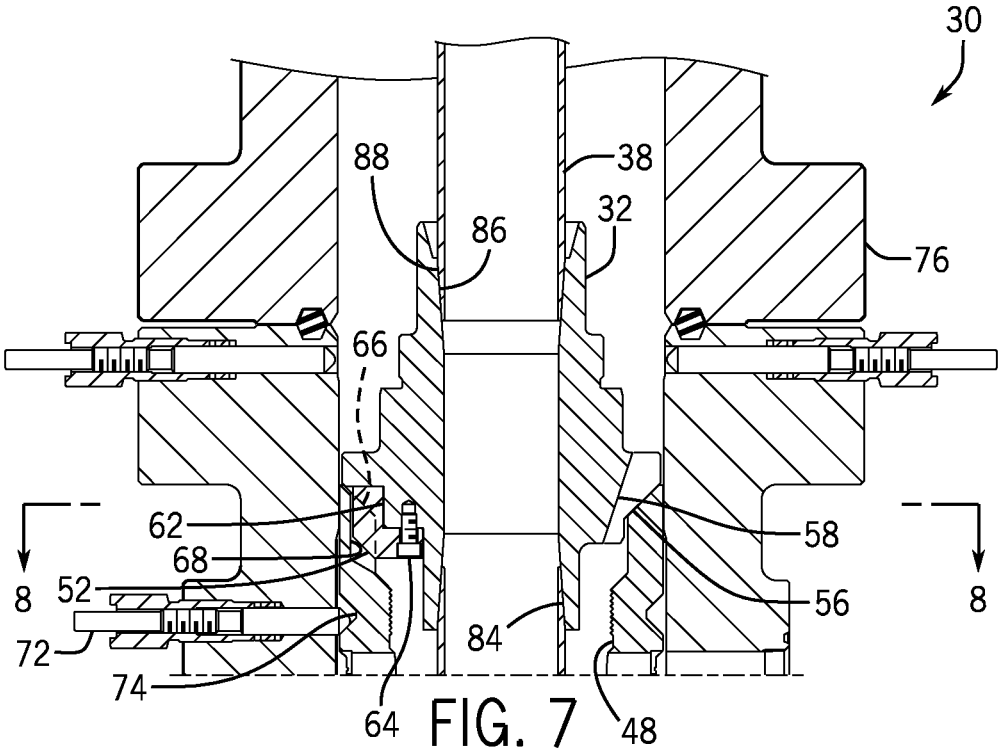
FIG. 7 depicts the casing hanger landed into keyed engagement with the landing shoulder of the packoff in accordance with one embodiment.
Figure 8:
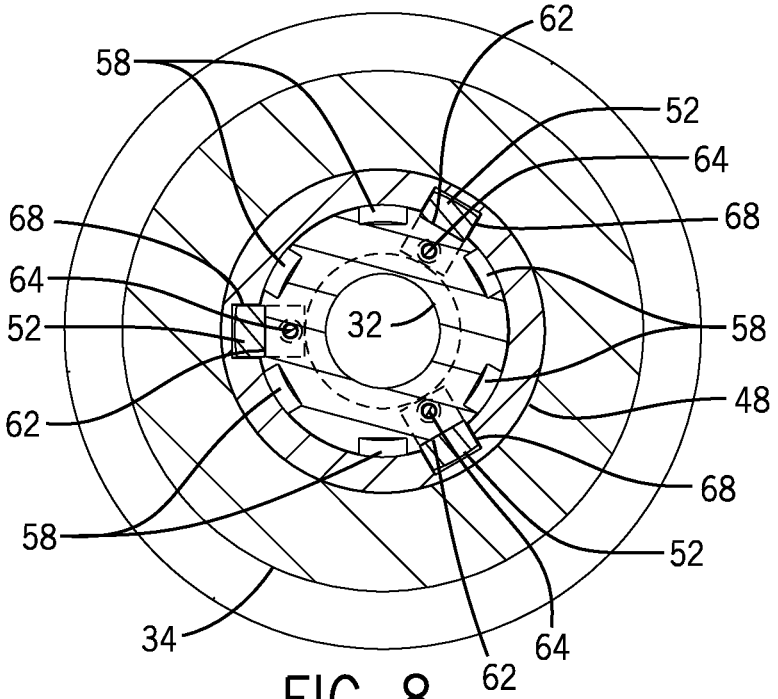
FIG. 8 is an axial cross-section showing the keyed engagement of the casing hanger and the landing shoulder of the packoff.
Figure 9:
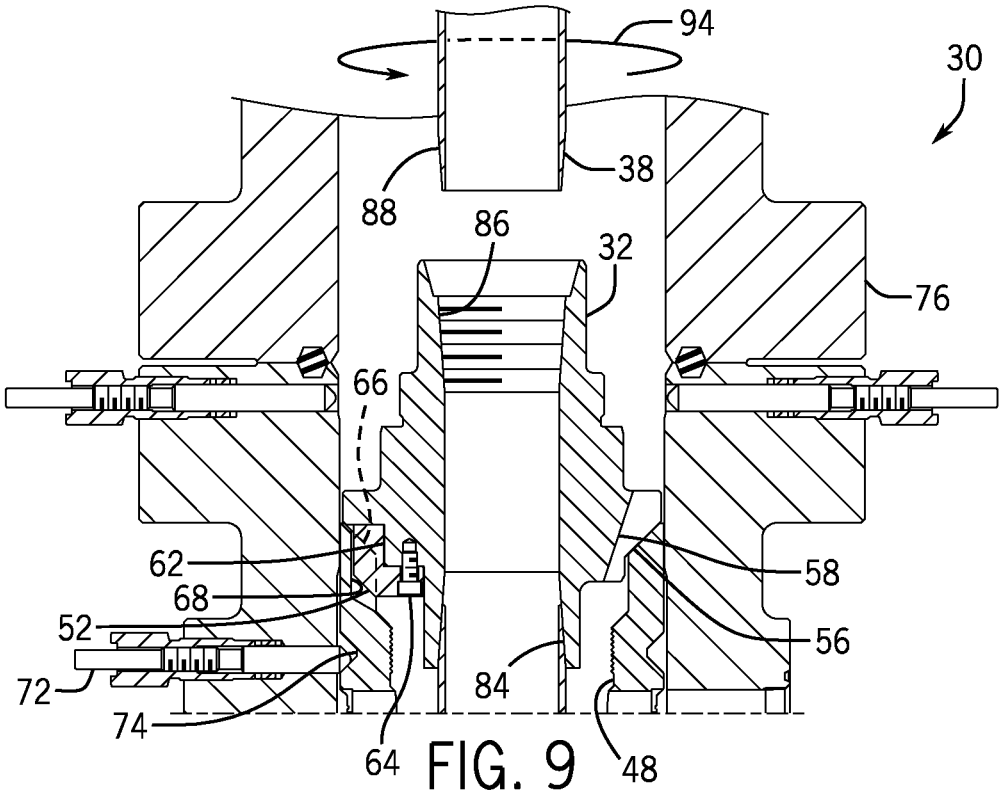
FIG. 9 generally depicts the disconnection of the landing joint from the casing hanger in accordance with one embodiment.

For example, the casing hanger 32 can be lowered into the keyed engagement with the landing shoulder 66, as generally depicted in FIGS. 7 and 8. In at least some embodiments, the casing hanger 32 is lowered to the landing shoulder 66 after a desired amount of rotation (e.g., to reduce voids in cement about the casing string 80). If the keys 52 are already rotationally aligned with the slots 68 when the casing hanger 32 is suspended above the landing shoulder 66, the casing hanger 32 can simply be lowered so that the keys 52 pass into the slots 68 and the shoulder 56 lands on the landing shoulder 66. If, however, the keys 52 and the slots 68 are not rotationally aligned as the casing hanger 32 is lowered, the keys 52 can first be landed on the landing shoulder 66. The casing hanger 32 can then be rotated to align the keys 52 with the slots 68 and lowered into keyed engagement with the landing shoulder 66. In at least some embodiments, an upward force is applied to the casing hanger 32 via the landing joint 38 when the keys 52 are landed on the landing shoulder 66 to reduce loading from the keys 52 on the shoulder 66. With the weight of the casing string 80 only partially supported by the landing joint 38, the keys 52 can be rotated along the landing shoulder 66 until aligned with the slots 68. Once the keys 52 and slots 68 are aligned, the weight of the casing string 80 can overcome the upward force and pull the casing hanger 32 down into keyed engagement with the landing shoulder 66.

Engagement of the casing hanger 32 with the landing shoulder 66, as generally shown in FIG. 8, prevents rotation of the casing hanger 32 and allows the casing hanger 32 to be released from the landing joint. Particularly, the locking engagement of the keys 52 within the slots 68 prevents the casing hanger 32 from rotating with the landing joint 38, allowing the landing joint 38 to be rotated (e.g., in the direction indicated by arrow 94 in FIG. 9) to unthread the landing joint 38 from the casing hanger 32. The disconnected landing joint 38 can then be removed from the wellhead assembly.

Additionally, although certain embodiments are described above as having mating engagement of the casing hanger 32 and the landing shoulder 66 of the packoff 48, other embodiments may take different forms. The casing hanger 32 could be landed on some other component besides the packoff 48, for example. Mating engagement of the casing hanger 32 with a landing shoulder of this other component (e.g., a casing head or another component disposed in the bore of a wellhead) could prevent rotation of the casing hanger 32 as an installation tool (e.g., a running tool connected to the landing joint 38 or the landing joint 38 alone) is unthreaded from the casing hanger 32.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a casing hanger; and a landing shoulder for receiving the casing hanger and supporting the casing hanger within a wellhead;

wherein the casing hanger and the landing shoulder have complementary features that cooperate to inhibit rotation of the casing hanger with respect to the landing shoulder, and the complementary feature of the landing shoulder is formed directly on a surface of the landing shoulder.

2. The system of claim 1, wherein the complementary features enable keyed engagement of the casing hanger with the landing shoulder.

3. The system of claim 2, wherein the casing hanger includes a key and the landing shoulder includes a keyway.

4. The system of claim 3, wherein the key includes a lug fastened to the casing hanger.

5. The system of claim 2, wherein the casing hanger includes a plurality of keys fastened to an exterior of the casing hanger and the landing shoulder includes a plurality of slots for receiving the keys.

6. The system of claim 1, wherein the casing hanger includes an upper end with a threaded surface to enable the casing hanger to receive a threaded end of a landing joint and to be inserted into the wellhead without a separate running tool joining the landing joint to the casing hanger.

7. The system of claim 1, comprising a packoff including the landing shoulder.

8. The system of claim 1, comprising the wellhead, wherein the casing hanger is installed in the wellhead.

9. A method comprising:

lowering a casing hanger into a wellhead assembly via a landing joint;

landing the casing hanger on a landing shoulder; and rotating the landing joint after landing the casing hanger on the landing shoulder while preventing rotation of the casing hanger with the landing joint through locking engagement of the casing hanger to the landing shoulder to release the casing hanger and enable removal of the landing joint from the wellhead assembly;

wherein the locking engagement of the casing hanger to the landing shoulder is provided via complementary locking features of the casing hanger and the landing shoulder, and landing the casing hanger on the landing shoulder includes lowering the casing hanger onto the landing shoulder such that the complementary locking features of the casing hanger and the landing shoulder engage each other without relative radial movement.

10. The method of claim 9, comprising rotating the casing hanger and a casing string connected to the casing hanger while cementing the casing string within a well.

11. The method of claim 10, wherein rotating the casing hanger includes rotating the casing hanger within the wellhead assembly through a blowout preventer stack.

12. The method of claim 9, wherein landing the casing hanger on the landing shoulder includes lowering the casing hanger into keyed engagement with the landing shoulder.

13. The method of claim 9, comprising attaching keys to the casing hanger and machining mating slots into the landing shoulder.

14. The method of claim 13, wherein machining the mating slots into the landing shoulder includes machining the mating slots into a packoff having the landing shoulder.

15. The method of claim 9, wherein releasing the casing hanger includes unthreading the landing joint from the casing hanger.

16. The method of claim 9, wherein the complementary locking feature of the landing shoulder is formed directly on a surface of the landing shoulder, and lowering the casing hanger onto the landing shoulder such that the complementary locking features of the casing hanger and the landing shoulder engage each other without relative radial movement includes lowering the casing hanger onto the landing shoulder such that the complementary locking feature of the casing hanger engages the complementary locking feature formed directly on the surface of the landing shoulder.

17. A system comprising:

a casing hanger; and a landing shoulder for receiving the casing hanger and supporting the casing hanger within a wellhead;

wherein the casing hanger and the landing shoulder have complementary features that cooperate to inhibit rotation of the casing hanger with respect to the landing shoulder, and the complementary features of the casing hanger and the landing shoulder are configured to engage each other without relative radial movement.

18. The system of claim 17, wherein the complementary feature of the landing shoulder is formed directly on a surface of the landing shoulder.

19. A method comprising:

lowering a casing hanger into a wellhead assembly via a landing joint;

landing the casing hanger on a landing shoulder; and rotating the landing joint after landing the casing hanger on the landing shoulder while preventing rotation of the casing hanger with the landing joint through locking engagement of the casing hanger to the landing shoulder to release the casing hanger and enable removal of the landing joint from the wellhead assembly;

wherein the locking engagement of the casing hanger to the landing shoulder is provided via complementary locking features of the casing hanger and the landing shoulder, the complementary locking feature of the landing shoulder is formed directly on a surface of the landing shoulder, and landing the casing hanger on the landing shoulder includes lowering the casing hanger onto the landing shoulder such that the complementary locking features of the casing hanger and the landing shoulder engage each other.

* * * * *